US005788127A

United States Patent [19]

Hanmer

[11] Patent Number: 5,788,127

[45] Date of Patent: Aug. 4, 1998

[54] LIQUID DISPENSING VALVE

[76] Inventor: Peter Hanmer, Roundhill Farm, Hollins Road, Waterhead, Oldham, 0L4 3SG, United Kingdom

[21] Appl. No.: 763,732

[22] Filed: Dec. 11, 1996

[51] Int. Cl.[6] ..... B67D 5/06

[52] U.S. Cl. ..... 222/422; 222/504

[58] Field of Search ..... 222/504, 422, 222/559; 141/31

[56] References Cited

U.S. PATENT DOCUMENTS

| | | | |
|---|---|---|---|
| 2,832,513 | 4/1958 | Tubin | 222/422 |
| 5,205,439 | 4/1993 | Sturm | 222/504 |
| 5,458,275 | 10/1995 | Centea et al. | 222/559 |
| 5,474,113 | 12/1995 | Rademacher et al. | 141/31 |

*Primary Examiner*—Philippe Derakshani
*Attorney, Agent, or Firm*—Bergert & Bergert

[57] ABSTRACT

A liquids dispensing valve comprising a cylindrical body (10) having a tapered outlet passage leading to an outlet orifice (12) at one end and an inlet orifice (30) at the other. Multiple pistons (18, 19, 20 and 21) depressed by springs (23, 24 and 25) progressively close the orifice (12). An air cylinder (14) with piston (16) progressively retracts the pistons (18, 19, 21) to open the valve and subsequently causes the valve to close progressively. Liquid flows downwardly through the ducts (28) in the valve in a generally axial or longitudinal direction and the subtended angle between the longitudinal axis of the body (10) and the wall of the tapered outlet passage is not more than 50°.

11 Claims, 1 Drawing Sheet

LIQUID DISPENSING VALVE

This invention concerns dispensing valves for liquids. In many process industries there is a requirement for accurate dispensing of liquids such as dyes, print pastes, paints, inks chemicals and additives, batches of which may consist of several individual components proportionally supplied and quantified by computer controlled gravimetric systems. Commensurate with the need for proportional and total content accuracy it is required to dispense the liquids as rapidly as possible into containers transported to or manually positioned beneath a series of dispensing heads or valves and later subsequently to a mixing station where the contents are thoroughly mixed. Speed of response of the valve is vital to achieve the high levels of accuracy which are required.

In order to maximise production rates the liquid must flow quickly but the required amounts must not be exceeded. Ideally, each component should be weighed to within 95% (typical) of its total and then to 100% without overweighing. Because of the high inertia of pumped liquids, particularly those of low viscosity, it is extremely difficult to dispense the required total amount with accuracy. To overcome this difficulty it is known to provide multiple flow dispensing valves i.e. those from which maximum flow may give way in the final stages to a dribble or even a drip pattern in order to arrive at the correct weight which has been requested, often by means of proportional closure of the valve aperture from maximum flow to a closed condition.

Several disadvantages have been experienced in the use of conventional multiple flow valves. For example, the valve closure piston or plug may stick owing to an accumulation of dried or partially dried material around the outlet orifice. A further disadvantage is slow response from the actuating mechanism within the valve, and a still further disadvantage occurs often due to the construction of the valve which prevents very low viscosity liquids from being dispensed in a smooth uniform column so that it is quite common for liquid to be sprayed or spattered at a shallow angle thus perhaps missing the container altogether and distributing hazardous or staining or messy materials upon surrounding equipment or the operators themselves. This can be due to a very shallow angle of the internal wall of the valve immediately behind the outlet orifice, or to the provision of a side entry at which the liquid enters the valve. Side entry valves tend to cause the liquid to assume a helical swirling motion within the valve leading to turbulence and uneven dispensing.

Furthermore, and perhaps for some of the above reasons conventional valves may cause inaccurate measurement, slow production and a requirement for frequent and regular cleaning and general maintenance.

The present invention seeks to minimise these disadvantages by operational and constructional improvements when compared with conventional designs.

According to the present invention a liquids dispensing valve comprises a cylindrical body having an outlet orifice in one end region thereof, an internal tapered outlet passage leading to the orifice, at least two co-axial pistons disposed within the body and having complementary tapered outer wall formations, and actuating means for moving the pistons axially within the outlet passage selectively to open and close the passage; characterised by at least one dispensed liquid duct extending within the body generally parallel to the longitudinal axis thereof and communicating with the outlet orifice; and in that the angle subtended by the longitudinal axis and the wall of said outlet passage is not more than 50°.

Preferably, a plurality of longitudinally extending passages are provided in the body and spaced angularly therein about the longitudinal axis thereof thus to enable generally axial flow of liquid into the tapered outlet passage, the actuating means for said at least two co-axial pistons being adapted to withdraw the pistons simultaneously from the outlet orifice or, selectively, to withdraw one or more such pistons with one or more further such pistons remaining in a closed position in the orifice.

An embodiment of the invention will now be described, by way of example only, with reference to the accompanying drawings, in which.

Figure 1:
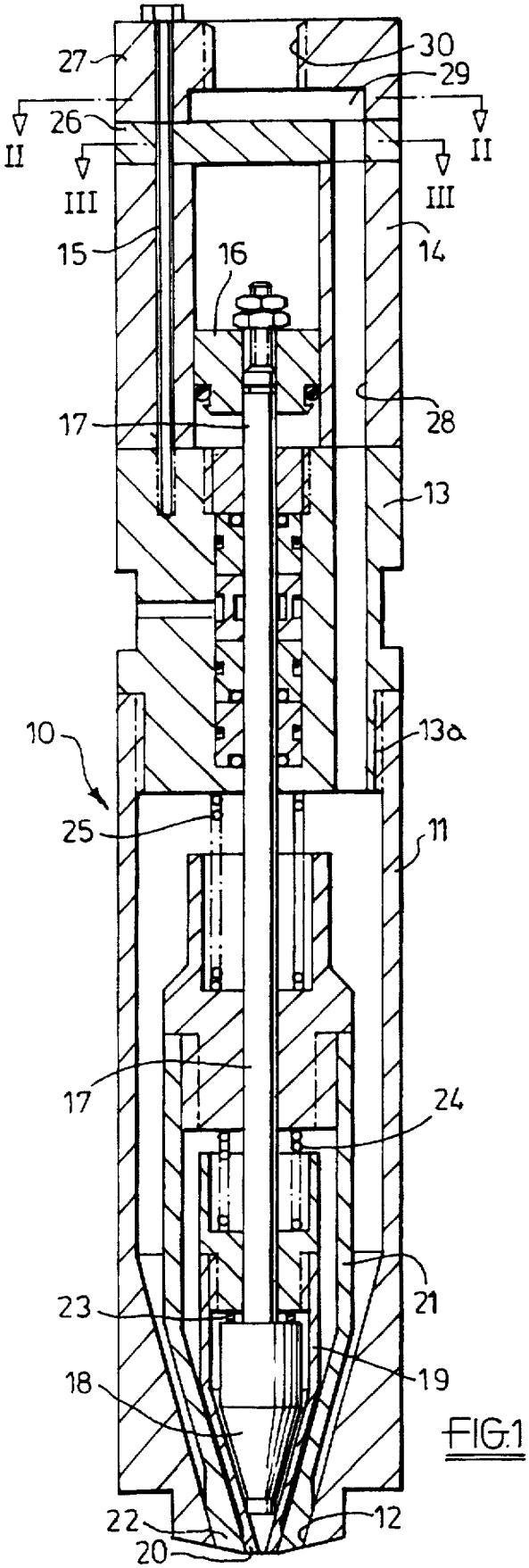
FIG. 1 is a longitudinal cross-sectional view of a dispensing valve made in accordance with the invention.
Figure 3:
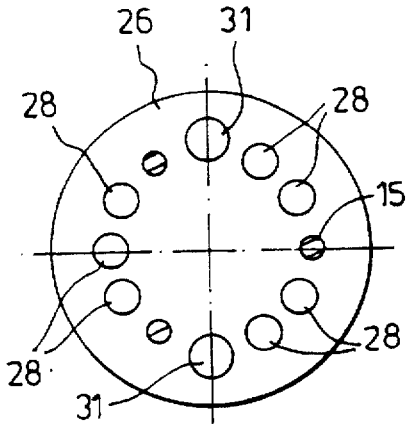

and FIG. 3 is a cross-section taken on line III—III of FIG. 1.

Referring now to the drawings, the valve in this embodiment comprises a housing generally indicated at 10 and consisting of a hollow cylinder 11 having an internal tapered outlet passage leading to an outlet orifice 12 at a bottom end thereof. A body 13 is threadedly attached at 13a to the upper end of the cylinder 11, and an air cylinder 14 is attached by screws 15 to the upper end of the body 13.

Within the air cylinder there is located a piston 16 having an actuator or piston rod 17 centrally attached thereto. The rod 17 extends downwardly through the body 13 and the cylinder 11, and carries at its lower end a drip piston 18 having a cylindrical upper part and a stepped conical lower part, the apex of which lies co-axially within the orifice 12. Surrounding the drip piston 18 and co-axially located therewith in the cylinder 11 is a dribble piston 19 of partially hollow formation and having a stepped tapered closure portion 20 adapted to be located co-axially within the orifice 12. Surrounding the dribble piston 19 is a flood piston 21 also of tapering wall formation and having a stepped tapered closure portion 22 adapted to be located co-axially within the orifice 12. A first co-axial coil spring 23 is disposed between an upper face of the drip piston 18 and a lower face within the dribble piston 19. A second co-axial coil spring 24 is disposed between an upper face of the dribble piston 19 and a lower face within the flood piston 21, and a third co-axial coil spring 25 is located between an upper face of the flood piston 21 and a lower face of the body 13. The rod 17 passes down through co-axial bores within pistons 21 and 19.

An air cylinder cap 26 is mounted above the air cylinder 14, and a distributor cap 27 is mounted on the cap 26.

Figure 2:
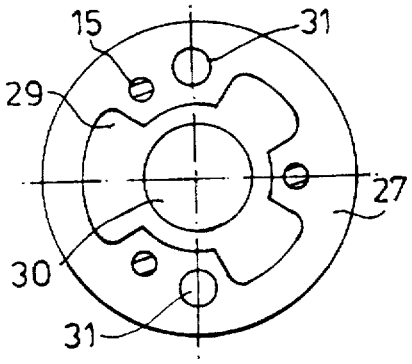
FIG. 2 is a transverse cross-section taken on line II—II of FIG. 1.

Several liquid ducts 28 extend downwardly through the air cylinder 14 and the body 13 at angularly spaced positions (see FIGS. 2 and 3) and each duct 28 communicates with a chamber 29 in the distributor cap 27 the chamber 29 communicating with an axial inlet orifice 30 for liquids to be dispensed. It will be seen that liquid may pass from the inlet orifice 30 into the chamber 29 and downwardly through the several ducts 28 into the interior of cylinder 11.

Ducts 31 are provided in the distributor cap 27 and the air cylinder cap 26 for the passage of compressed air to and from the air cylinder 14.

In operation the valve is opened by introducing compressed air into the air cylinder 14 beneath the piston 16 causing it to rise and withdraw the drip piston 18, the dribble piston 19 and the flood pistons 21 to a raised position within the cylinder 11 whereby pumped liquid may flow from inlet 30 through ducts 28 and out of the outlet orifice 12 at a maximum flow rate. The steep angle of the frusto-conical wall of the outlet passage in the cylinder 11 leading to the outlet orifice 12, together with the supply of liquid generally in the longitudinal direction through the valve ensures in-line flow within the valve and a smooth uniform flow pattern from the outlet orifice.

The compressed air supply to the air cylinder 14 is determined by a controlling computer (not shown) receiving signals representing gravimetric sensing of the weight of liquid increasing in a container placed beneath the valve, whereby when the requested component is weighed to approximately 95% (typical) of its total, the actuating rod 17 is caused to descend fully such that the pistons 18, 19 and 21 advance into the outlet orifice 12 closing the valve.

Depending upon the residual amount of liquid required to complete the requested weight of the components, appropriate signals from the computer will then cause compressed air to actuate the piston 16 and the rod 17 thus to withdraw from the outlet orifice 12 either the drip piston 18 alone or both pistons 18 and 19 to allow the remaining portion of the required liquid to drip or dribble into the container as appropriate. Should both pistons be withdrawn then the computer may cause them both to descend once again into the closed position at, say 98% of the required weight whereupon the drip piston 18 may be withdrawn to drip the final 2% (typical) of liquid into the container.

In an alternative mode of operation the computer may cause the pistons 21, 19 and 18 to close progressively towards the end of the filling cycle thus always to finish off with the finer adjustment provided by the drip piston. In this case, the final stage of the operation of the valve is to cause the rod 17 to descend completely so that the pistons fully occupy the outlet orifice and prevent any further flow.

The preferred angle subtended between the tapering wall of the outlet passage of cylinder 11 which is equivalent to the angle of the external walls of the flood, dribble and drip pistons, and the longitudinal axis of the valve is in the region of 15°–20°, and it is this steep angle together with the generally axial or in-line flow of liquid through the valve which serves to ensure a smooth flow pattern in all open conditions of the valve thus avoiding the problems of spattering experienced with conventional valves in which the valve members have a tendency to stick, with dried materials tending to accumulate around the outlet orifice leading to erratic spray patterns around the periphery of the orifice.

It will be appreciated that a valve made in accordance with the invention may be operated either by positively opening and closing the different valve stages or, in some cases, by infinite variation of the orifice size by progressively advancing and retracting the pistons.

The valve is produced largely from stainless steel components with co-polymer materials being used for the valve pistons. Thus the entire device is rust-proof and resistant to a large number of chemicals often required to be dispensed in industrial processes. The valve is designed to remain in a closed condition without maintaining a supply of compressed air above the air cylinder piston.

It is not intended to limit the invention to the above details. For example, while a three-stage valve is described and illustrated herein the valve may consist of more or less stages depending upon the variation of flow pattern required for a particular application.

A valve made in accordance with the invention is capable of uniform and efficient operation resulting in accurately measured quantities of a wide range of liquid viscosities and types from, for example, water to thickened print paste, whereas conventional valves must be designed specifically for a narrow range of liquids.

A fully computer controlled dispensing and batching system may be established incorporating valves made in accordance with the invention. Such a system creates the ability to place a number of containers at one end of a production line and to transport them sequentially to a filling station in which containers of for example 120 kilograms of mixed liquids with four or five liquid components may be filled each in a period of two to three minutes and then transported onward for mixing and for further use.

I claim:

1. A liquids dispensing valve comprising a cylindrical body having an outlet orifice in one end region thereof, an internal tapered outlet passage leading to the orifice, at least two co-axial pistons disposed within the body and one within the other, and having complementary tapered outer wall formations, and actuating means for moving the pistons axially within the outlet passage selectively to open and close the outlet orifice; characterised by at least one duct for liquid to be dispensed, extending within the body generally parallel to the longitudinal axis thereof and communicating with the outlet orifice; and in that the angle subtended by the longitudinal axis and the wall of the tapered outlet passage is not more than 50°.

2. A liquids dispensing valve according to claim 1, wherein the angle subtended by the longitudinal axis and wall of the tapered outlet passage is in the region of 15° to 20°.

3. A liquids dispensing valve according to claim 1, including a plurality of longitudinally extending passages within the body and spaced angularly therein about the longitudinal axis thereof to enable the generally axial flow of liquid therethrough into the tapered outlet passage.

4. A liquids dispensing valve according to claim 1, wherein the actuating means for said at least two co-axial pistons is adapted to withdraw the pistons simultaneously from the outlet orifice.

5. A liquids dispensing valve according to claim 1, wherein the actuating means for said at least two co-axial pistons is adapted to withdraw one or more such pistons, with one or more further such pistons remaining in a closed position in the outlet orifice.

6. A liquids dispensing valve according to claim 1, wherein the cylindrical body is attached to an air cylinder having a piston rod extending axially through the cylindrical body and attached to one of said pistons being a drip piston of conical formation the apex of which lies co-axially within the outlet orifice.

7. A liquids dispensing valve according to claim 6, wherein the other or another of said pistons is a dribble piston of at least partially hollow formation co-axially surrounding the drip piston.

8. A liquids dispensing valve according to claim 7, wherein a flood piston of at least partially hollow formation co-axially surrounds the dribble piston.

9. A liquids dispensing valve according to claim 1, including at least one coil spring co-axially disposed between said at least two co-axial pistons.

10. A liquids dispensing valve according to claim 1, including an inlet orifice axially disposed at the end of the valve remote from the outlet orifice, communication between the inlet and outlet orifices being provided by a plurality of said ducts extending within the body generally parallel to the longitudinal axis thereof.

11. A liquids dispensing valve according to claim 1, in combination with a controlling computer connected to said actuating means and adapted to control the opening and closing movements of said at least two pistons such as to discontinue flow of liquid through the valve when a requested liquid component is weighed to approximately 95% of its total and subsequently to control movement of at least one of said pistons to increase the weight of the component to 100% of its total.

* * * * *